US007066355B2

(12) United States Patent
Lewis et al.

(10) Patent No.: US 7,066,355 B2
(45) Date of Patent: Jun. 27, 2006

(54) SELF-CONTAINED VISCOUS LIQUID DISPENSER WITH A FOAMING PUMP

(75) Inventors: Richard P. Lewis, Marietta, GA (US); Victor S. Shoaf, Alpharetta, GA (US); Cleary E. Mahaffey, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 157 days.

(21) Appl. No.: 10/877,053

(22) Filed: Jun. 25, 2004

(65) Prior Publication Data

US 2005/0284887 A1 Dec. 29, 2005

(51) Int. Cl.
*B67D 5/60* (2006.01)

(52) U.S. Cl. ..... 222/145.5; 222/181.3; 222/190

(58) Field of Classification Search ..... 222/145.5, 222/145.6, 181.3, 189.11, 190, 481.5
See application file for complete search history.

(56) References Cited

U.S. PATENT DOCUMENTS

| | | | |
|---|---|---|---|
| 5,779,104 | A | 7/1998 | Reidel |
| 5,887,762 | A | 3/1999 | Hanna |
| 6,533,145 | B1 | 3/2003 | Lewis et al. |
| 6,543,651 | B1 | 4/2003 | Lewis et al. |
| 6,575,334 | B1 | 6/2003 | Lewis et al. |
| 6,575,335 | B1 | 6/2003 | Lewis et al. |
| 6,648,179 | B1 | 11/2003 | Lewis et al. |
| 6,729,502 | B1 | 5/2004 | Lewis et al. |
| 2002/0056730 | A1 | 5/2002 | van de Heijden |
| 2003/0000967 | A1 | 1/2003 | Ehrensperger et al. |

FOREIGN PATENT DOCUMENTS

| | | |
|---|---|---|
| WO | 0249490 | 6/2002 |
| WO | 03059524 | 7/2003 |

OTHER PUBLICATIONS

PCT Search Report, Aug. 9, 2005.
Product Information-Airspray International, Jun., 2004.

*Primary Examiner*—Joseph A. Kaufman
(74) *Attorney, Agent, or Firm*—Dority & Manning

(57) ABSTRACT

A self contained viscous liquid dispenser with a foaming pump mechanism includes a housing defining an internal liquid reservoir. A foaming pump mechanism is configured with the housing and includes a horizontally disposed pump chamber fitted through an opening in the housing to extend into the reservoir. A pump cylinder is slidably disposed and retained in the chamber. Actuation of the pump cylinder results in a liquid/air mixture within the pump chamber being pressurized and dispensed from the chamber as a foam.

20 Claims, 6 Drawing Sheets

SELF-CONTAINED VISCOUS LIQUID DISPENSER WITH A FOAMING PUMP

FIELD OF THE INVENTION

The present invention relates to the field of viscous liquid dispensers, for example soap dispensers, and particularly to a viscous liquid dispenser having a foaming pump mechanism.

BACKGROUND OF THE INVENTION

Various configurations and models of liquid dispensers, particularly liquid soap dispensers, are well known in the art. Conventional dispensers employed in public restrooms and the like are wall mounted units that typically include a house or structure that is permanently affixed to a wall. These dispensers usually include an access door or member so that the dispenser can be opened by a maintenance person for refilling or servicing. With certain types of dispensers, separate refill cartridges are inserted into the housing structure. With other types of dispensers, the maintenance technician must directly refill a reservoir provided in the housing structure. The dispensers typically include a delivery device, such as a dosing pump, and a device such as a lever or button for actuating the dosing pump. The dispensers may be vented or unvented.

Improved dispensers particularly suited for use as soap dispensers are described in detail in the following U.S. Pat. Nos. 6,533,145; 6,543,651; 6,575,334; and 6,575,335.

In various environments and uses of dispensers, it is often desirable to convert and dispense the liquid stored in a dispenser as a foam. Foam is often preferred by the consumer and less of the liquid is needed per measured dose of foam, thus extending the time between refill or replacement of the dispenser. Foaming pumps are know in the art for this purpose, and typically work by mixing the liquid with air and forcing the mixture through a separator, such as a screen. For various reasons, however, such foaming pump mechanisms have not been widely used or incorporated with relatively large volume dispensers of the type preferred for use in public restrooms, and the like.

The present invention provides an improvement to the type of viscous liquid dispensers described in the U.S. patents cited above, and particularly provides an internal foaming pump mechanism with such dispensers.

OBJECTS AND SUMMARY OF THE INVENTION

Objects and advantages of the invention will be set forth in part in the following description, or may be obvious from the description, or may be learned through practice of the invention.

The present invention provides a self-contained viscous liquid dispenser having a foaming pump mechanism. Although having particular usefulness as a liquid soap dispenser, the dispenser according to the invention is not limited to a liquid soap dispenser and may be utilized in any application wherein it is desired to dispense metered doses of a viscous liquid as a foam. The liquid dispenser will be described herein with reference to a soap dispenser for ease of explanation.

The viscous liquid dispenser includes a housing that may be formed of any suitable material. For example, the housing may be molded from relatively inexpensive plastic materials and may have any desired aesthetic shape. The housing also defines an integral sealed internal liquid reservoir. In other words, the liquid reservoir is not a separate component from the housing, such as a cartridge or the like. The housing may be comprised of wall members that give the dispenser its outward appearance and also define the internal liquid reservoir.

A foaming dispensing pump mechanism is disposed at least partially within the reservoir. The pump mechanism has a delivery end that extends out of the reservoir and is actuated by a user to dispense the viscous liquid.

In a particular embodiment, the foaming pump mechanism includes a horizontally disposed pump chamber that is fitted into an opening defined near the bottom of a front surface of the housing. The pump chamber extends into the reservoir and has a back end open to said reservoir and a front end open to the outside of the housing. A siphon tube may be attached to the back end of the pump chamber and be oriented towards the bottom of the reservoir to ensure that as much liquid as possible is dispensed from the reservoir in a vertical orientation of the housing.

A pump cylinder is slidably disposed and retained in the pump chamber and includes a delivery end that extends out of the pump chamber and a delivery channel defined therethrough. The pump cylinder is movable within the pump chamber from a rest position to a pressurizing position. Upon movement of the pump cylinder from the pressurizing position back to the rest position, a metered amount of the liquid within the reservoir is siphoned into the pump chamber through the back of the chamber, for example through the siphon tube.

The pump cylinder further includes at least one air intake passage defined therethrough and disposed so that air is drawn into the pump chamber and mixes with the metered amount of liquid as the pump cylinder returns from its pressurizing position to its rest position. The air intake is sealed upon the pump cylinder moving from the rest position to the pressurizing position such that the liquid/air mixture within the pump chamber is pressurized and dispensed out of the pump chamber through the delivery channel in the pump cylinder.

A unique advantage of a particular embodiment of the inventive dispenser is the ease of assembly of the components. The housing may be formed as an integral unit, or the combination of a front component permanently attached to a back component, which may be clear or translucent. A hole is defined in the housing for receipt of the pump chamber, which is simply slid into the hole from the front of the housing. The pump cylinder may then be slid into the chamber with the delivery end of the cylinder extending beyond the wall of the housing in which the hole is defined. A mounting flange may then be fitted over the delivery end of the pump cylinder and attach directly to the wall of the housing to retain the pump cylinder within the pump chamber, and to retain the pump chamber within the housing. A screen insert member can be readily press fitted or otherwise attached into the delivery end of the pump cylinder, and a nozzle may be pressed onto the delivery end of the pump cylinder to redirect flow of the dispensed foam mixture.

In a particular embodiment for attaching the mounting flange, the housing includes a plurality of protrusions extending from the front surface and disposed around the opening in the housing. The mounting flange includes a plurality of holes defined therethrough into which the protrusions extend upon mounting the flange onto the housing. The protrusions may then be melted so as to flow into the holes to permanently retain the mounting flange relative to the housing.

The dispenser also includes an actuator configured with the delivery end of the pump cylinder for a user to move the pump cylinder from its rest position to the pressurizing position. The actuator may be any aesthetically pleasing mechanism that engages with the delivery end of the pump cylinder, for example via a nozzle pressed onto the pump cylinder, to move the cylinder upon the user pressing the actuator.

The dispenser may also include a mounting mechanism that may be configured as an integral component of the housing. The mounting mechanism allows the dispenser to be detachably connected to complimentary mounting structure on a wall surface. In this way, the dispenser may be easily removed from the wall surface for disposal or recycling once the liquid has been depleted. A new or replacement dispenser according to the invention may then be attached to the wall surface.

A vent path is defined into the reservoir to prevent drawing a vacuum therein. In a particularly desired embodiment, the vent is provided in a top surface of the housing structure. Since the housing structure is mounted in use upon a wall surface, there is little concern of the liquid leaking from the vent in the top surface. In other embodiments, the reservoir may be vented through the pump mechanism. However, venting through the pump mechanism may result in undesired leakage through the mechanism, particularly if the pump mechanism is disposed in the lower portion of the housing. Venting may also be accomplished through the valve mechanism in the delivery end of the pump cylinder.

It should be appreciated that the configuration and appearance of the housing is not a limiting feature of the invention. Also, the invention is not limited to the use of any particular type of materials or manufacturing process. Various embodiments of interlocking engagement structure between the back side of the housing and the wall mounting member are also within the scope and spirit of the invention. For example, the engaging structure may include bayonet type fasteners, or the like.

The invention will be described in greater detail below with reference to particular embodiments illustrated in the figures.

DETAILED DESCRIPTION

Figure 1:
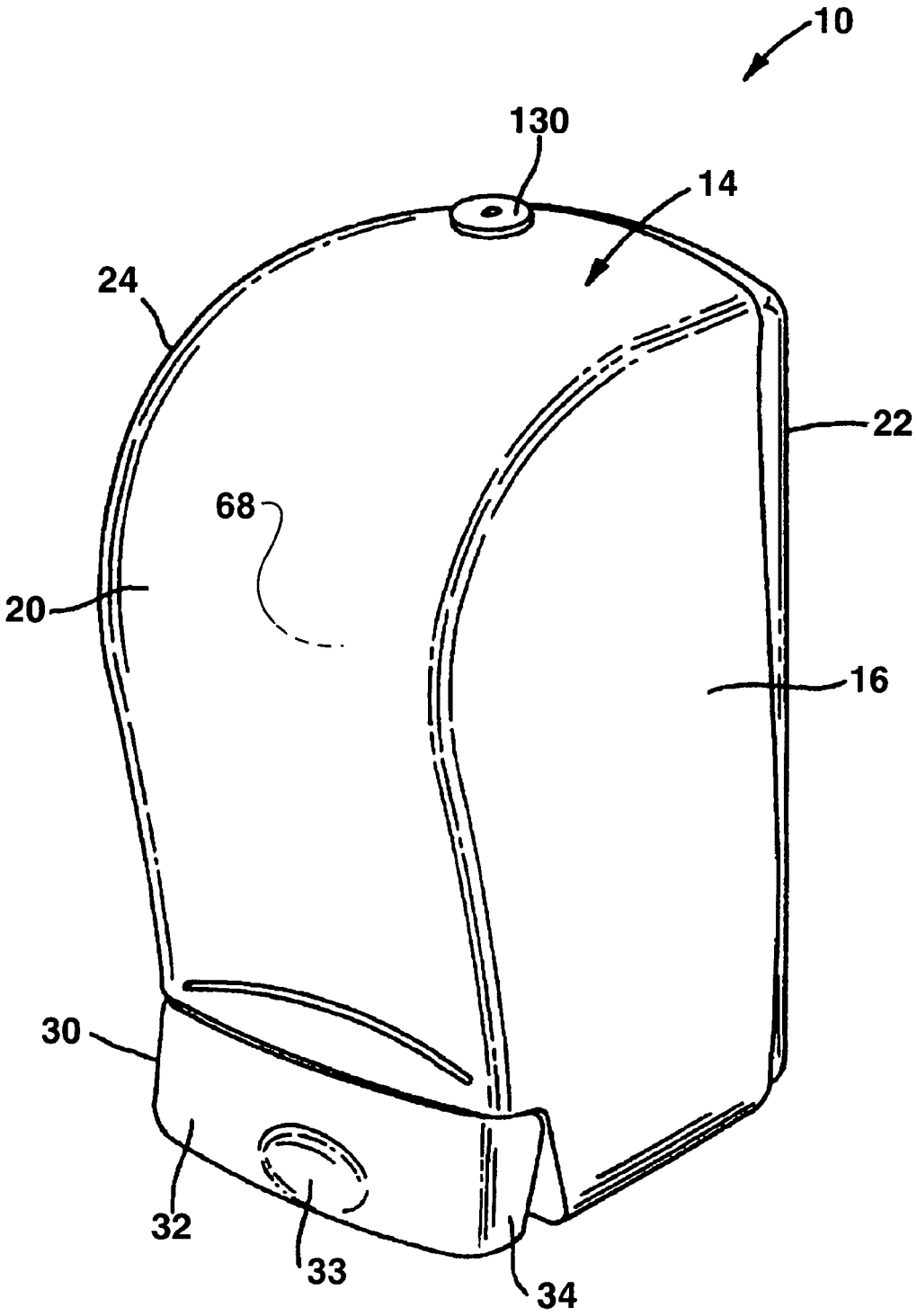
FIG. 1 is a perspective view of a dispenser according to the present invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

A viscous liquid dispenser 10 with a foaming pump mechanism 200 according to the invention is illustrated generally in the figures. The dispenser 10 is illustrated and described herein as a liquid soap dispenser, which is a particularly useful embodiment of the present invention. However, it should be appreciated that the present invention is not limited to a dispenser for liquid soap, but has application in any environment wherein it is desired to dispense a metered amount of a viscous liquid from a dispensing unit as a foam.

Various aspects of the dispenser 10 are described in the commonly owned U.S. Pat. Nos. 6,533,145; 6,543,651; 6,575,334; and 6,575,335 cited above. These patents are incorporated herein by reference in their entirety for all purposes.

Figure 4:
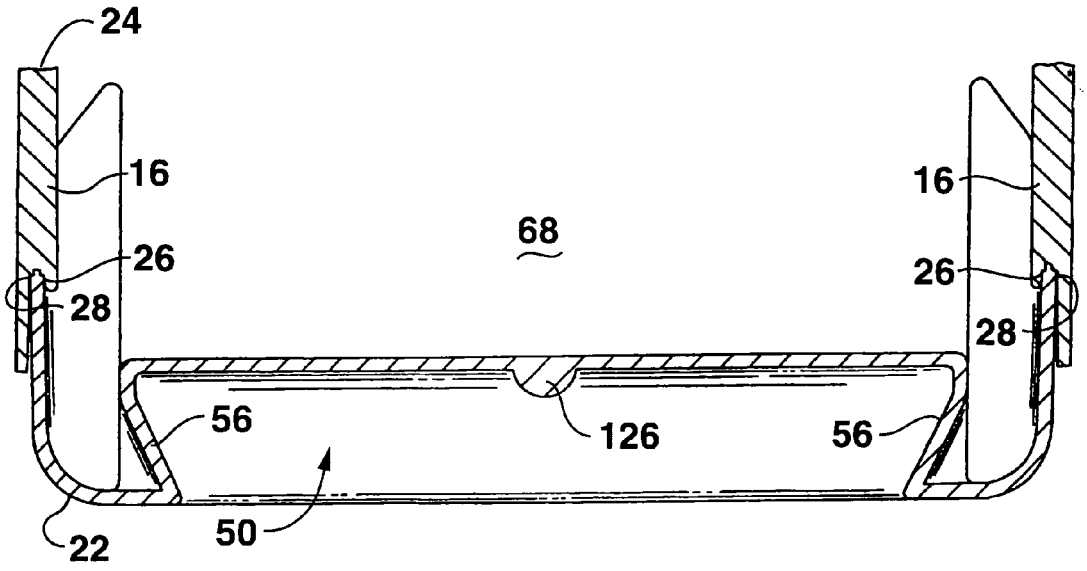
FIG. 4 is a cross-sectional view of the dispenser taken along the lines indicated in FIG. 3.

The dispenser 10 includes a housing, generally 14. The housing 14 may contain side walls or members 16, a back side 18, and a front side 20. The housing 14 can take on any desired configuration and be formed from any number of components. In the illustrated embodiment, the housing 14 includes a front component 24 and a back component 22. The front and back components are separately manufactured and are permanently joined. It should be appreciated that the components may be manufactured from any desired material. In a preferred embodiment, the dispenser 10 is a disposable item and the housing 14 is molded from a relatively inexpensive plastic material. Referring particularly to FIG. 4, the back component 22 may be molded from a clear or translucent plastic and includes side edges 26 and alignment tabs (not visible) that align the back component 22 relative to the front component 24. The side edges 26 fit into correspondingly sized recesses 28 defined in the side walls 16 of the front component 24. The back component 22 is permanently joined to the front component 24 by adhesives, welding, or any other relatively permanent attaching means.

The housing 14 defines an internal liquid reservoir 68 within the internal volume thereof. In the illustrated embodiment, the liquid reservoir 68 includes essentially the entire volume defined by the front component 24 and back component 22. Although not illustrated, it should be understood that any number of internal structural members, such as baffles or the like, may be included within the reservoir 68. It should be understood that the housing 14 thus also serves as a closed or sealed reservoir and the dispenser 10 cannot be opened by the maintenance technician. A desired amount of viscous liquid, for example soap, is preloaded into the dispenser 10 prior to the dispenser being delivered to its point of use.

Figure 5:
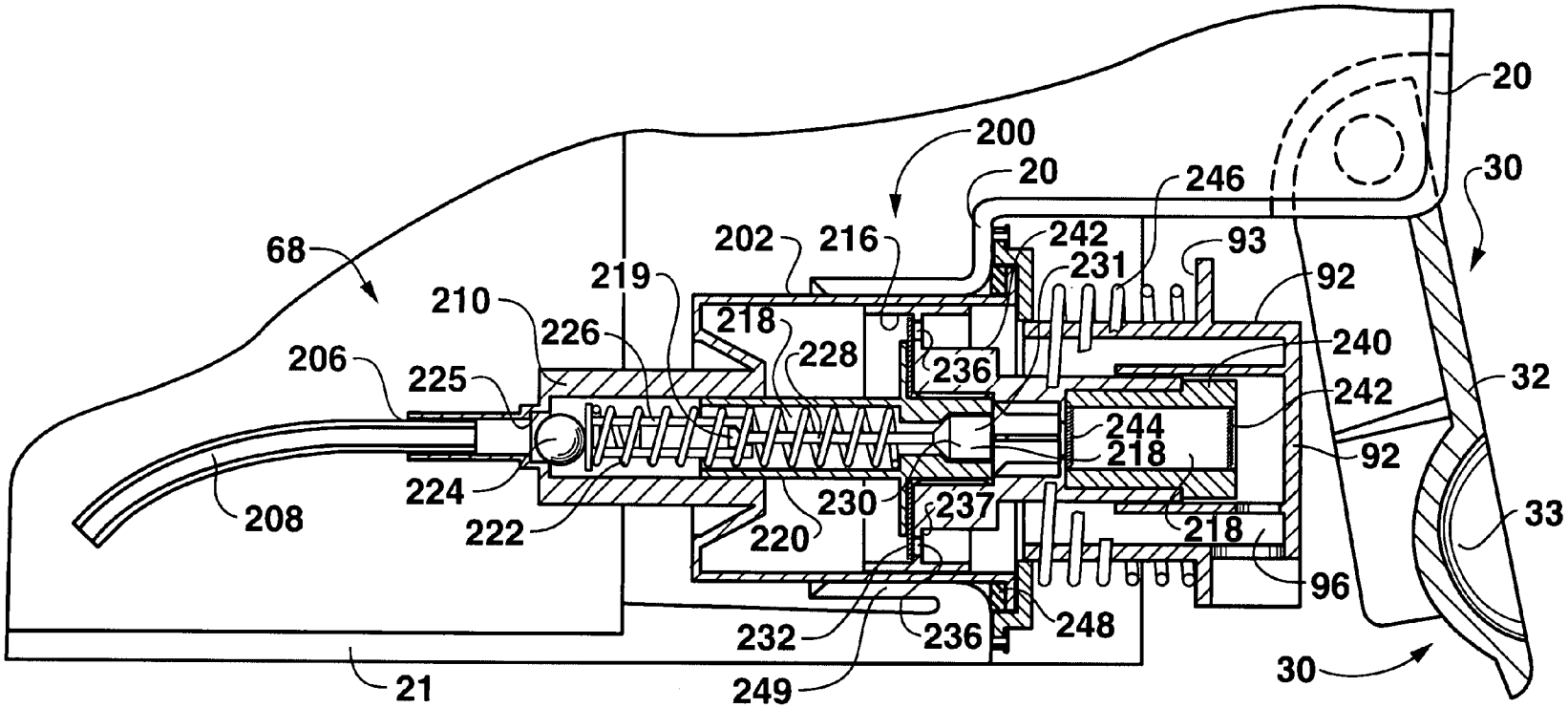
FIG. 5 is a cross-sectional view of the foaming pump mechanism of the dispenser taken along the lines indicated in FIG. 3.
Figure 6:
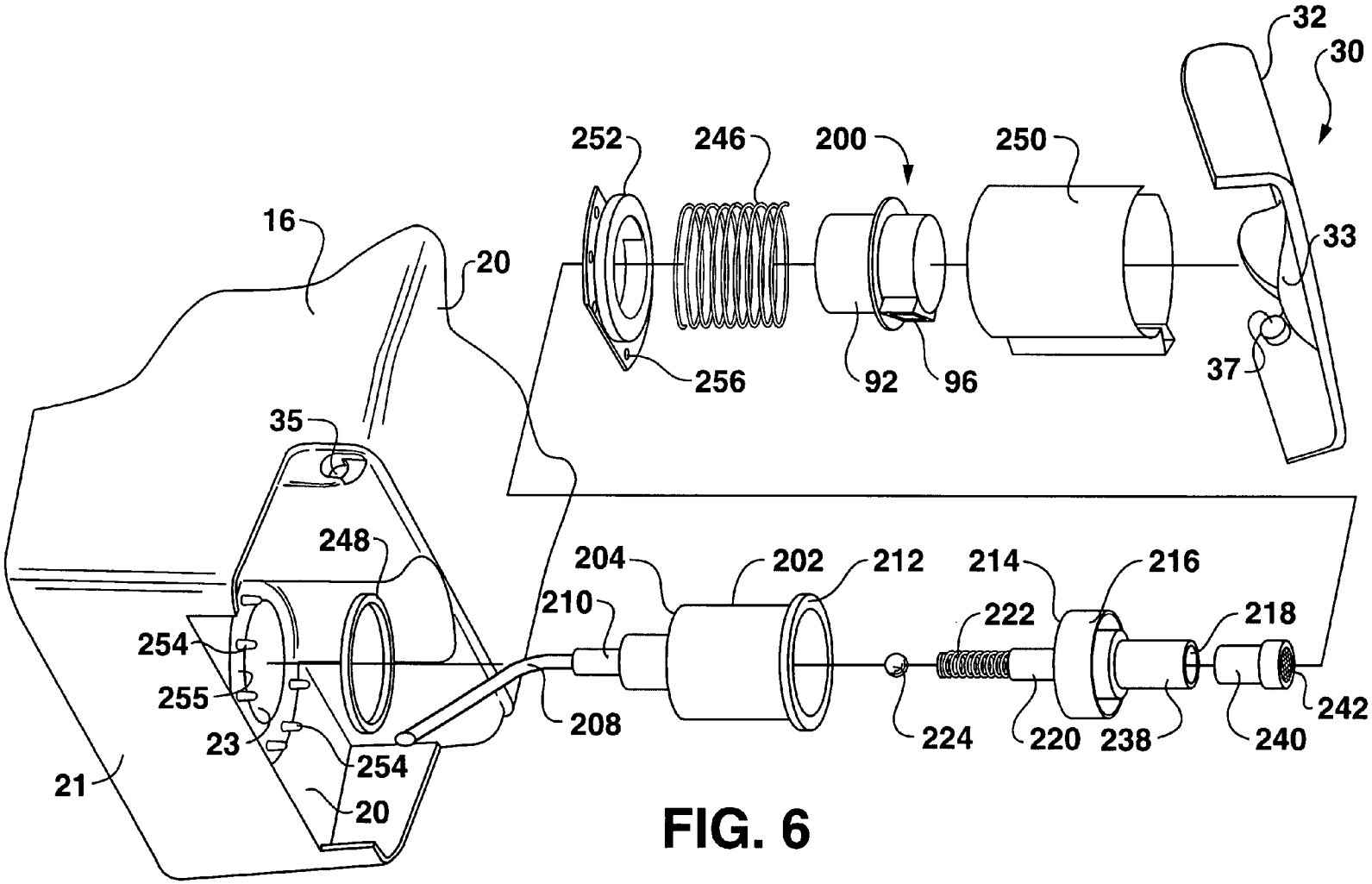
FIG. 6 is an in-line component view of the foaming pump mechanism illustrated in FIG. 5.

An embodiment of a foaming dispensing pump mechanism that may be used with the dispenser 10 according to the invention is illustrated particularly in FIGS. 5 and 6 as pump mechanism 200. The illustrated pump mechanism 200 is manufactured by Airspray International, Inc. of Pompano Beach, Fla., USA. and is similar in many aspects to a commercial pump mechanism supplied by Airspray Intl. And identified as Model M3. The pump mechanism 200 as described herein is modified for use with dispensers according to the present invention.

The pump mechanism 200 includes a pump chamber 202 that is fitted through an opening or bore 23 defined in the front face 20 of the housing 14 generally near the bottom surface 21 of the housing. A cylindrical extension 249 may extend from the opening 23 into the interior of the housing 14. The pump chamber 202 is a generally cylindrical member that fits into the opening and cylindrical extension 249 and includes a forward flange 212 (FIG. 6) that abuts against the front face 20 of the housing and prevents the chamber 202 from sliding completely into the reservoir 68. The chamber 202 has a back end 204 that is in liquid communication with the reservoir 68 so that liquid from the reservoir can be drawn into the pump chamber 202. For example, in the illustrated embodiment, the back end 204 includes a reduced diameter longitudinally extending portion 210 having an opening 206 defined in the end thereof disposed within the reservoir 68. A siphon tube 208 may be press fitted or otherwise attached to the extension 210 and have a pre-formed bend so that the open end of the siphon tube 208 is disposed very near the bottom surface 21 of the housing. In this way, nearly all of the liquid contained in the reservoir 68 is dispensed prior to replacing the dispenser 10.

A pump cylinder is slidably disposed within the pump chamber 202, and is placed into the chamber 202 from the open front end of the chamber. Various configurations of a pressurizing pump cylinder may be used. A suitable embodiment is the pump cylinder 214 illustrated in the figures. The cylinder 214 includes a sealing surface 216 that engages and slides along the inner wall of the pump chamber 202 as the pump cylinder is moved from its rest position show in FIG. 5 to a pressurized position, as explained below.

The pump cylinder 214 has a rearwardly extending tube-like member 220 that defines a portion of a delivery channel 218 that extends completely through the cylinder 214. A plunger member 228 is contained within the delivery channel 218 and includes a conically shaped seal head 230 disposed within a correspondingly shaped recess 231 formed in the pump cylinder 214. The recess 231 forms a portion of the delivery channel 218. The opposite end of the plunger member 228 includes a nub 219 that is received within a pipe-like member 226, which in turn extends rearwardly beyond the end of the extension 220. The pipe member 226 and plunger 228 are thus axially movable relative to each other. A spring 222 has one end disposed against a flange on the rearward end of the pipe member 226, and an opposite end disposed within the extension 220. The spring 222 thus biases the pipe member 226 away from the extension 220 such that the pipe member 226 pulls the plunger member 228 axially rearward and the sealing head 230 seats against the wall of the recess 231 and seals the delivery channel 218 in the rest position of the pump cylinder illustrated in FIG. 5.

A check valve is provided to seal the opening 206 into the pump chamber 202 in the pressuring position of the pump cylinder 214, and to unseal the opening 206 as the cylinder 214 returns from a pressurized position to its rest position. In the illustrated embodiment, the check valve is in the form a ball 224 that is biased into a ball seat 225 by the spring-biased pipe member 226 as the pump cylinder moves rearward within the pump chamber 202. It the rest position of the pump cylinder shown in FIG. 5, the ball is not in sealing engagement with the ball seat 225.

A forward longitudinally extending portion of the pump cylinder 214 defines a generally cylindrical delivery end 238 that extends out of the pump chamber 202 beyond the portion of the housing front surface 20 in which the opening 230 is defined. The delivery end 238 includes an internal passage that defines a portion of the overall delivery channel 218.

To enhance formation of a foam from the liquid/air mixture dispensed from the pump chamber 202, at least one screen may be disposed generally transversely across the delivery channel 218. In the illustrated embodiment, a screen insert 240 is press-fitted into the internal passage of the delivery end 238, as seen in FIG. 5. The screen insert 240 may include one or more screens, such as screens 244 and 242 at opposite ends of the insert 240.

A nozzle 92 may be provided to redirect foam expelled from the front end of the delivery end 238 of the pump cylinder 214. For example, in the illustrated embodiment, the nozzle 92 directs horizontally flowing foam downwardly to an exit orifice 96. The orifice 96 is oriented such that the foam is directed into the hand of user upon the actuation of the pump mechanism. The nozzle 92 may be pressed onto or otherwise attached to the delivery end 238, or may be formed integral with the delivery end 238. A biasing spring 246 is disposed between a flange 93 on the nozzle 92 and the front surface 20 of the housing, or mounting structure attached to the front surface 20 as described below. The spring 246 biases the pump cylinder 214 in the axially forward direction to its rest position illustrated in FIG. 5.

At least one opening is defined in the pump cylinder to provide an air passage from the forward portion to the rearward portion of the sealing surface member 216. In the illustrated embodiment, a web 237 (FIG. 5) extends radially outward from the central axial portion of the pump cylinder 214 to the sealing surface member 216, and at least one opening 236 is defined through this web. For example, a ring of openings 236 may be defined in the web. As explained below, the openings 236 serve to draw air into the pump chamber 202 as the pump cylinder returns from its pressurized position to its rest position illustrated in FIG. 5. A flexible seal 232, such as a film or gasket material is provided adjacent the face of the web 237 within the pump chamber 202. This seal 232 serves to seal the openings 236 as the sealing surface member 216 is moved into the pump chamber 202 to pressurize the liquid/air mixture, and to unseat and allow air to be drawn into the pump cylinder 202 as the cylinder 214 returns to its rest position.

In the illustrated embodiment, a mounting flange 252 is used to retain the components the pump mechanism 200 in their respective operational positions. A plurality of nubs or protrusions 254 extend from the front surface 20 of the housing and surround the opening 23. The protrusions 254 may be molded integral with the housing front surface 20, or may extend from a separate ring member 255 that is adhered or otherwise permanently attached to the front surface 20.

To assemble the pump mechanism 200 within the housing 14, the cylinder 214 and associated components are fitted into the pump chamber 202. A gasket 248 (FIG. 5) or other suitable seal is fitted over the pump chamber and abuts against the forward flange 212 of the pump chamber 202. The chamber and cylinder combination is then fitted into the opening 23 and slidably engages with the cylindrical extension 249 to form a seal between the outer cylindrical surface of the pump chamber 202 and the extension 249. If desired, a seal or adhesive may be provided between the outer surface of the pump chamber 202 and the extension 249. The mounting flange 252 is then slid over the delivery end 238 of the pump cylinder and attached to the front surface of the housing 20 (or ring 255), as discussed below. The mounting flange 252 thus mounts the pump chamber 202 to the housing 14 and retains the pump cylinder 214 within the pump chamber 202.

The mounting flange 252 includes a plurality of counter-bored holes 256 arranged in a pattern matching the protrusions 254. The back side of the flange 252 is pressed against the front surface 20 of the housing and the protrusions 254 extend through the holes 256. The flange 252 is permanently attached to the housing front surface 20 by melting the protrusions 254 in a "heat stake" process so that the molten material flows into the counter-bored holes 256 and thus anchors the mounting flange 252 upon hardening. The heat stake process compresses the gasket 248 thus forming an additional seal between the pump cylinder 202 and the housing 14. It should be appreciated that many other suitable devices, structure, and methods could be used to anchor or secure the pump mechanism 200 within the housing 14, including adhesives, welding, etc.

Operation of the pump mechanism 200 is initiated by a user pressing on an actuator 30. The actuator 30 will be described in greater detail below. Upon depressing the actuator 30, the pump cylinder 214 and associated components (i.e., nozzle 92, screen insert 240) are moved rearward and the sealing surface member 216 is moved within the pump chamber 202 against the biasing force of spring 246. As the sealing surface member 216 moves, pressure of the viscous liquid and air within the chamber forces the seal 232 against the web 237 to seal the openings 236. The ball 224 is also urged into the ball seat 225 to seal off the back end of the pump chamber 202. When the pump cylinder 214 moves rearward, the biasing force of the spring 222 on the plunger member 228 is relieved and the plunger seal head 230 unseats from the surface of the recess 231. The air and liquid within the pump chamber are mixed and pressurized as the pump cylinder moves rearward, and the liquid/air mixture is forced into the delivery channel 218 in the rearward extension 210 of the pump cylinder. The pressurized mixture flows through the delivery channel 218 around the plunger seal head 230 and to the delivery end 238 of the pump cylinder 214. The pressurized mixture is forced through the screens 244 and 242 where the mixture is converted to a foam consistency and expelled through the nozzle 92.

When the user releases the actuator 30, the spring 246 causes the pump cylinder 214 to return to its rest position. As the sealing surface member 216 moves forward within the pump chamber 220, the spring 222 pulls the plunger seal head 230 rearward within the recess 231 to seal the delivery channel 218. A vacuum is thus created within the pump chamber 220 causing the seal 232 to unseat from the web 237 and allowing air to be drawn into the chamber 220 through the openings 236. Also, the ball 224 is drawn off of the ball seat 225 and liquid from the reservoir 68 is drawn into the pump chamber 220 through the siphon tube 208. At the rest position of the pump cylinder 214, the ratio of air to liquid drawn into the chamber is about 4:1. It should be appreciated, however, that this ratio may be any desired ratio depending on the design of any number of variables, such as the volume of the chamber 220, size of the opening 236, size of the siphon tube 208, and so forth. It should also be understood that these variations, e.g., air/liquid ratio, chamber size, opening size, screen size, and so forth, will affect the characteristics of the foam delivered to the user.

So as not to draw a vacuum within the reservoir 68, the reservoir is vented. This venting may be accomplished by various means. One preferred venting method as illustrated in the figures is to vent the top of the housing 14, for example by way of a conventional vent valve 130 disposed through the top surface of the housing 14. A suitable vent valve 130 is illustrated and described, for example, in U.S. Pat. No. 6,575,335 incorporated herein by reference. Preferably, the valve 130 is designed to seal an opening provided the top surface of the housing 14 upon an overfill condition of the viscous liquid, or upon the housing 14 being overturned during shipment or the like. Once the dispenser is hung on a wall surface for subsequent use, the valve 130 unseats to vent the reservoir 68. It is also convenient to initially fill the dispenser 10 with a desired viscous liquid through the hole in the top of the housing 14 into which the valve 130 is subsequently inserted.

As mentioned, the pump mechanism 200 is operated by a user depressing an actuator 30. The actuator 30 may be any member configured to move the pump cylinder 214. In one embodiment illustrated in the figures, the actuator 30 is defined by a panel member 32 that adds a distinctive aesthetically pleasing look to the housing 14. The panel member 32 includes side walls 34 having inwardly disposed protrusions 37 that engage within correspondingly sized divots or recesses 35 provided in the sides 16 of the housing 14. A depression 33 may be defined in the front face of panel member 32 to indicate to a user the proper location for depressing the actuator. It should be appreciated that the actuator may take on any configuration or aesthetically pleasing shape.

FIG. 6. illustrates a shipping clip 250 that is particularly useful during shipment of the dispensers 10. The clip 250 may be placed over the nozzle 92 and delivery end 238 of the pump cylinder 214 between the actuator 30 and front surface 20 of the housing. The clip 250 thus prevents inadvertent movement of the actuator 30 and actuation of the pump mechanism 200. Upon installing the dispenser 10 in an intended location, the clip 250 may be removed and discarded.

Figure 3:
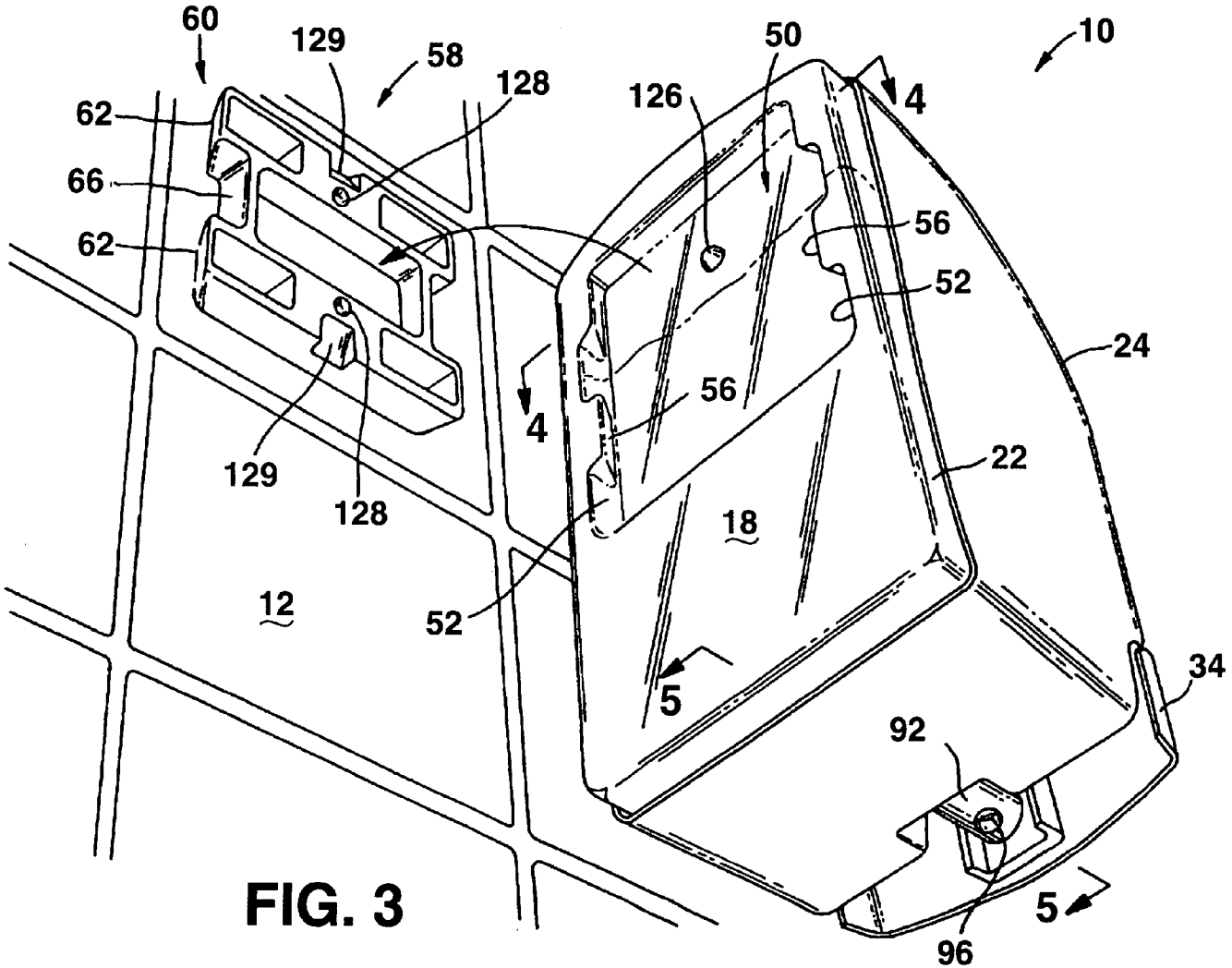
FIG. 3 is an alternative perspective view of the dispenser according to FIG. 1 and complimentary wall mounting structure.

The dispenser 10 according to the invention may also include an integrally formed mounting mechanism configured as an integral component of the housing 14. This mounting mechanism allows the dispenser 10 to be detachably connected with complimentary mounting structure, generally 58, provided on a wall surface 12 (FIG. 3). In one embodiment according to the invention, the mounting mechanism is defined as an integrally molded feature of the back side 18 of the dispenser 10. In the illustrated embodiment, a recess 50 is molded into the back side 18. The recess 50 is defined by generally vertical side walls 52. Engaging structure is provided along the side walls 52 for engaging against or with complimentary structure provided on the wall mounting structure 58, as discussed in greater detail below. In the illustrated embodiment, the engaging structure is defined by angled surfaces 56 defined along the vertical walls 52. The angled surfaces 56 engage against complimentary angled surfaces 62 defined on the wall mounting structure 58, as can be particularly seen in FIG. 4. In the illustrated embodiment, at least two angled surfaces 56 are provided and are separated by a section of vertical wall 52. The two angled surfaces 56 engage against angled surfaces 62 of the wall mounting structure 58. In order to attach the dispenser 10 to the wall mounting structure 58, the maintenance technician simply positions the dispenser 10 against the wall mounting structure 58 such that the angled surfaces 56 are vertically disposed between the corresponding angled surfaces 62 of the wall mounting structure. Then, the maintenance technician simply slides the dispenser 10 in a vertical direction so that the angled surfaces 56, 62 engage. In this interlocking configuration, the dispenser cannot be pulled away from the wall mounting structure 58. The double angled surface 56 configuration provided on each vertical wall 52 is particularly useful in that it provides an increased interlocking surface area of angled surfaces with relatively little vertical movement required between the dispenser 10 and the wall mounting structure 58 as compared to a single angled surface 56 having the same longitudinal surface area.

Once the dispenser 10 has been properly located on the wall mounting structure 58, it is desirable to include a securing device to indicate to the technician that the dispenser 10 has been properly positioned and to prevent removal of the dispenser 10 without a concerted effort. In the embodiment illustrated, the securing device comprises a protrusion 126 extending from the back side 18 of the housing within the recess 50. The protrusion 126 slides up a ramp surface 129 defined in the mounting structure 58 and snaps into a correspondingly sized divot 128 disposed adjacent to the ramp surface 129.

The wall mounting structure 58 may comprise any manner of suitable attaching structure. In the illustrated embodiment, the wall mounting structure 58 is defined by a plate member 64 that is attached to the wall surface 12, for example by screws, adhesives, or the like. The wall mounting structure 58 serves simply to provide an interlocking engagement device for the dispenser 10. It should be appreciated that any manner of interlocking engaging configurations may be provided for detachably connecting the dispenser 10 to complimentary wall structure provided on a supporting wall. For example, relatively simple bayonet type fasteners, spring loaded latches, and the like, may be provided in this regard. A desirable feature of the invention is that the entire dispenser 10 is disposable and, thus, relatively simple yet reliable engagement devices preferred. It has been found that the double angled surface configuration as illustrated and described herein is particularly useful in this regard.

Figure 2:
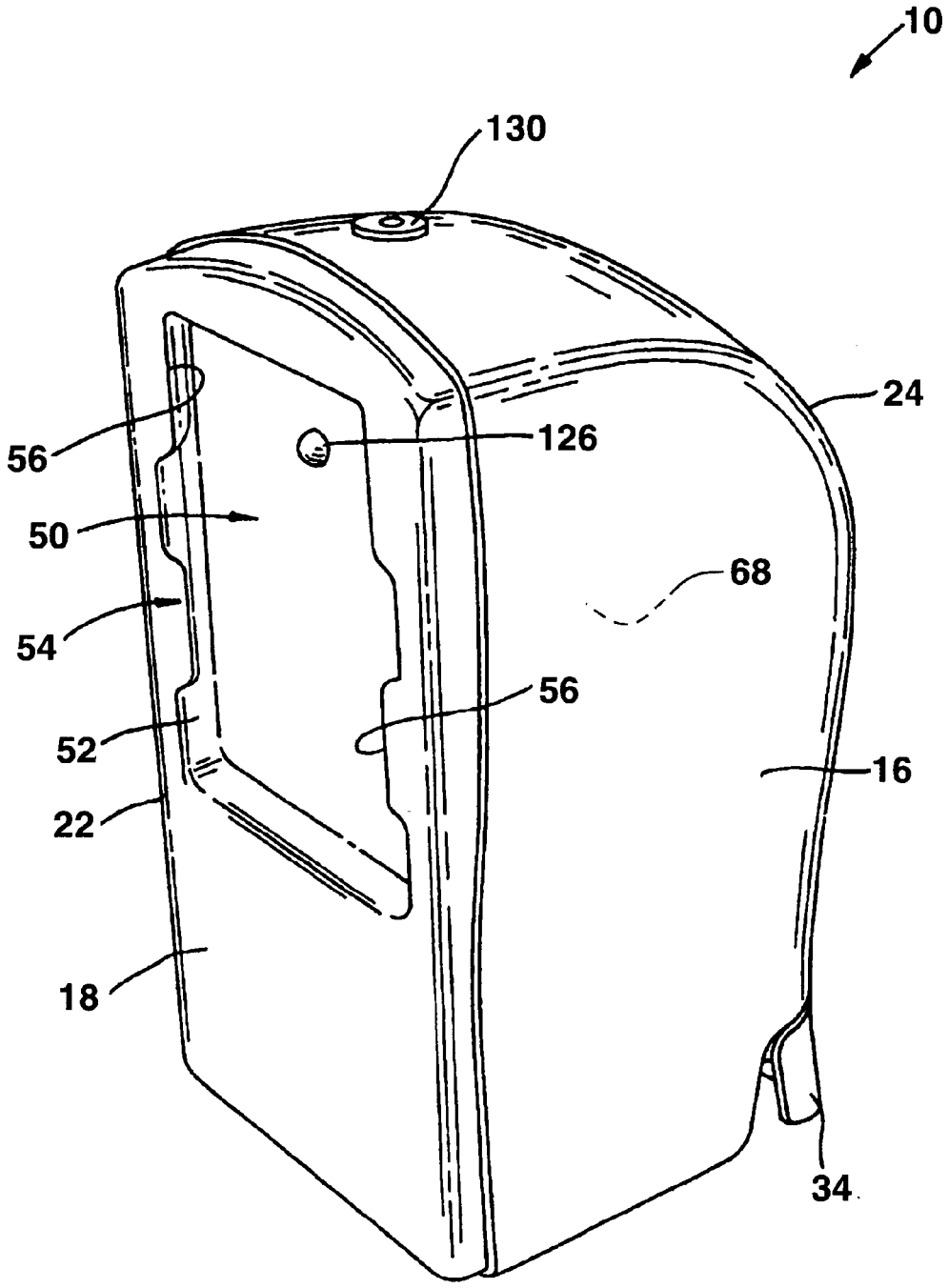
FIG. 2 is a back perspective view of the dispenser illustrated in FIG. 1.

It may also be desired to provide means for the maintenance technician to determine the level of viscous liquid within the dispenser. In this regard, as discussed above, a portion of the housing 14 may be formed from a translucent or clear material. In the embodiment illustrated particularly in FIGS. 1–3, the entire back component 22 is formed from a translucent or clear material so that the service or maintenance technician can view the remaining liquid level from the side of the dispenser. In an alternative embodiment, a window of clear or translucent material may be provide anywhere in the housing 14, preferably near the bottom portion of the housing, to provide the maintenance technician with the capability of viewing inside the reservoir to determine the remaining amount of liquid therein.

It should be appreciated that the invention includes modifications and variations to the embodiments of the invention described herein.

What is claimed is:

1. A self contained viscous liquid dispenser with a foaming pump mechanism, comprising:

a housing defining an internal liquid reservoir, said housing including a front surface having an opening therethrough adjacent a bottom surface of said reservoir;

a horizontally disposed pump chamber fitted through said opening, said pump chamber extending into said reservoir and having a back end open to said reservoir and a front end open to the outside of said housing, said pump chamber attached to said housing at said front surface;

a pump cylinder slidably disposed and retained in said chamber, said pump cylinder having a delivery end extending out of said pump chamber and a delivery channel defined therethrough, said pump cylinder movable within said pump chamber from a rest position to a pressurizing position;

said pump cylinder further comprising at least one air intake passage defined therethrough and disposed so that air is drawn into said pump chamber as said pump cylinder moves from said pressurizing position to said rest position, said air intake being sealed upon said pump cylinder moving from said rest position to said pressurizing position such that a liquid/air mixture within said pump chamber is pressurized and dispensed out of said pump chamber through said delivery channel; and a mounting flange fitted over said opening and retaining said pump cylinder within said pump chamber, said mounting flange secured to said front surface of said housing.

2. The dispenser as in claim 1, wherein said housing comprises a plurality of protrusions extending from said front surface and disposed around said opening, said mounting flange having a plurality of holes defined therethrough into which said protrusions extend upon mounting said flange onto said housing.

3. The dispenser as in claim 2, wherein said holes are counter-bored and said protrusions are melted so as to flow into said holes to permanently retain said mounting flange relative to said housing.

4. The dispenser as in claim 1, wherein said mounting flange is a separate component from said pump cylinder.

5. The dispenser as in claim 1, further comprising an actuator configured with said delivery end of said pump cylinder to move said pump cylinder from said rest position to said pressurizing position from outside of said housing.

6. The dispenser as in claim 1, further comprising a screen disposed in-line in said delivery channel through which said liquid/air mixture flows upon being dispensed from said pump cylinder.

7. The dispenser as in claim 6, wherein said screen is contained in a screen insert member, said screen insert member fitted into a front end of said delivery end.

8. The dispenser as in claim 1, further comprising a vent defined in an upper surface of said housing.

9. The dispenser as in claim 1, further comprising a nozzle member fitted to said delivery end, said nozzle diverting horizontally flowing foam to a downward generally vertical flow direction.

10. The dispenser as in claim 1, further comprising an actuator member pivotally connected to said housing and in contact against a forward end of said nozzle.

11. The dispenser as in claim 1, wherein said pump cylinder is spring biased to said rest position.

12. The dispenser as in claim 1, wherein said housing comprises a generally flat back wall mountable onto a mounting structure placed on a supporting wall.

13. A self contained viscous liquid dispenser with a foaming pump mechanism, comprising:

a housing defining an internal liquid reservoir, said housing including a front surface having an opening therethrough adjacent a bottom surface of said reservoir;

a horizontally disposed pump chamber fitted through said opening, said pump chamber extending into said reservoir and having a back end open to said reservoir and a front end open to the outside of said housing;

a pump cylinder slidably disposed and retained in said chamber, said pump cylinder having a delivery end extending out of said pump chamber and a delivery channel defined therethrough, said pump cylinder movable within said pump chamber from a rest position to a pressurizing position;

said pump cylinder further comprising at least one air intake passage defined therethrough and disposed so that air is drawn into said pump chamber as said pump cylinder moves from said pressurizing position to said rest position, said air intake being sealed upon said pump cylinder moving from said rest position to said pressurizing position such that a liquid/air mixture within said pump chamber is pressurized and dispensed out of said pump chamber through said delivery channel; and a mounting flange formed separately from said pump chamber, said mounting flange retaining said pump cylinder within said pump chamber and having a radially extending portion that is non-removably attached to said front surface of said housing to retain said pump chamber and pump cylinder combination in position relative to said housing.

14. The dispenser as in claim 13, wherein said housing comprises a plurality of protrusions extending from said front surface and disposed around said opening, said mounting flange having a plurality of holes defined therethrough into which said protrusions extend upon mounting said insert member into said housing, said protrusions melted so as to flow into said holes to permanently retain said mounting flange relative to said housing.

15. The dispenser as in claim 13, further comprising a screen disposed in-line in said delivery channel through which said liquid/air mixture flows upon being dispensed from said pump cylinder.

16. The dispenser as in claim 13, further comprising a vent defined in an upper surface of said housing.

17. The dispenser as in claim 13, further comprising a nozzle member fitted to said delivery end, said nozzle diverting horizontally flowing foam to a downward generally vertical flow direction.

18. The dispenser as in claim 17, further comprising an actuator member pivotally connected to said housing and in contact against a forward end of said nozzle.

19. The dispenser as in claim 13 wherein said pump cylinder is spring biased to said rest position.

20. The dispenser as in claim 13, wherein said housing comprises a generally flat back wall mountable onto a mounting structure placed on a supporting wall.

* * * * *